US008292285B2

(12) United States Patent
Yokoya et al.

(10) Patent No.: US 8,292,285 B2
(45) Date of Patent: Oct. 23, 2012

(54) SHEET PROCESSING APPARATUS, IMAGE FORMING APPARATUS AND SHEET BUFFERING DEVICE THAT MAINTAIN ALIGNMENT OF SHEETS OF SHEET BUNDLE

(75) Inventors: Takashi Yokoya, Kashiwa (JP); Toshiyuki Miyake, Abiko (JP); Mitsuhiko Sato, Kashiwa (JP); Yutaka Ando, Toride (JP)

(73) Assignee: Canon Kabushiki Kaisha (JP)

( * ) Notice: Subject to any disclaimer, the term of this patent is extended or adjusted under 35 U.S.C. 154(b) by 0 days.

(21) Appl. No.: 13/109,361

(22) Filed: May 17, 2011

(65) Prior Publication Data

US 2011/0285072 A1 Nov. 24, 2011

(30) Foreign Application Priority Data

May 18, 2010 (JP) ..... 2010-114470
May 10, 2011 (JP) ..... 2011-105478

(51) Int. Cl.
*B65H 29/66* (2006.01)
*B65H 33/04* (2006.01)

(52) U.S. Cl. ..... 270/58.31; 270/58.01; 270/58.32; 271/285; 271/286

(58) Field of Classification Search ..... 270/58.01, 270/58.04, 58.31, 58.32; 271/184, 285, 286
See application file for complete search history.

(56) References Cited

U.S. PATENT DOCUMENTS

| | | | | |
|---|---|---|---|---|
| 5,112,034 | A * | 5/1992 | Uto et al. | 270/58.12 |
| 6,227,531 | B1 * | 5/2001 | Guerrero et al. | 270/58.31 |
| 7,111,839 | B2 * | 9/2006 | Nishimura | 270/58.23 |
| 7,306,214 | B2 * | 12/2007 | Iida et al. | 270/58.11 |
| 7,445,207 | B2 * | 11/2008 | Obuchi et al. | 271/228 |
| 2008/0001340 | A1 * | 1/2008 | Yamamoto | 270/58.31 |

FOREIGN PATENT DOCUMENTS

JP 2001-097631 A 4/2001

* cited by examiner

*Primary Examiner* — Leslie A Nicholson, III
(74) *Attorney, Agent, or Firm* — Rossi, Kimms & McDowell LLP

(57) ABSTRACT

A sheet processing apparatus capable of maintaining alignment of sheets of a sheet bundle on a processing tray even in a job uses sheets including particular sheets. In the sheet processing apparatus (finisher), a sheet conveyed along a conveying path is retained in a buffer path. The sheet and the following sheet are stacked on a processing tray in a state superposed with a shift in a conveying direction. A finisher controller determines in advance, before a conveyed sheet reaches the buffer path, whether or not the sheet is a particular sheet having a protrusion. When the sheet retained in the buffer path and the following sheet are to be superposed one upon the other, the amount of the shift between the sheets in the conveying direction is controlled according to a result of the determination by the finisher controller.

9 Claims, 15 Drawing Sheets

SHEET PROCESSING APPARATUS, IMAGE FORMING APPARATUS AND SHEET BUFFERING DEVICE THAT MAINTAIN ALIGNMENT OF SHEETS OF SHEET BUNDLE

BACKGROUND OF THE INVENTION

1. Field of the Invention

The present invention relates to a sheet processing apparatus having a buffer function for retaining following sheets during execution of post processing, such as binding, on sheets having undergone print processing, an image forming apparatus, and a sheet buffering device.

2. Description of the Related Art

Conventionally, there has been proposed a sheet processing apparatus that performs processing, such as conveyance, stacking, and sorting, on sheets discharged from an image forming apparatus or the like. The sheet processing apparatus has a conveying path provided therein with a section for temporarily side-tracking a sheet, and temporarily stops conveyance of the sheet at the side-tracking section (buffer holding operation) and then superimposes the sheet on another sheet conveyed from upstream and conveys the sheets superimposed one upon the other (buffer conveying operation).

It has been proposed to secure time required for sheet processing performed downstream of the side-tracking section in the sheet conveying path by the buffer conveying operation, to thereby avoid degradation of the overall processing efficiency of sheet processing. Hereafter, the buffer holding operation and the buffer conveying operation will be generically referred to as "the buffer processing".

In the prior art, in a case where the buffer processing is performed by superposing a plurality of sheets one upon another into a buffered bundle, the buffered bundle is conveyed with the leading edges of the superimposed sheets shifted from each other (see e.g. Japanese Patent Laid-Open Publication No. 2001-097631). Specifically, timing for superposing sheets one upon another is determined based on detection of the leading edge of each of the sheets. The sheets are shifted from each other such that a leading-page sheet is positioned most upstream in a sheet conveying direction and following-page sheets are sequentially shifted downstream in the sheet conveying direction, so as to facilitate alignment of the trailing edges of the superimposed sheets stacked on a processing tray.

However, in a case where the buffer processing is performed based on the leading edge of each sheet as described above, when a particular sheet, such as a tab sheet, having a non-straight leading edge is buffered, a sensor for detecting the leading edge of a sheet can detect the tab portion of the tab sheet as the leading edge of the same, and hence there is a fear of the sheet being improperly shifted.

In the sheet leading edge-based buffer processing, the sheet shift direction is determined in consideration of alignment of sheets superimposed into a bundle, such that a leading-page sheet is positioned most upstream in the sheet conveying direction and following-page sheets are sequentially shifted downstream in the sheet conveying direction. In doing this, the leading edge of a sheet is detected differently by the sensor for detecting the leading edge of a sheet being conveyed, depending on whether the sensor detects the tab portion of a tab sheet or the edge of a sheet other than a tab sheet. Consequently, the shift direction of the trailing edge of a sheet relative to another sheet can become different between the above-mentioned two cases.

As a solution to this problem, it can be envisaged that a plurality of sensors are arranged in a lateral direction orthogonal to the sheet conveying direction to thereby reliably detect a sheet edge other than a tab portion for execution of the buffer processing. However, since it is required to provide the plurality of sensors, increase in cost cannot be avoided.

Thus, even when a tab sheet or the like sheet having a non-straight leading edge is to be subjected to the buffer processing, it is required to execute superposition control which makes it possible to ensure the relationship with another sheet in the direction of shift of the trailing edge of the tab sheet from the other sheet, without using a plurality of sensors.

SUMMARY OF THE INVENTION

The present invention provides a sheet processing apparatus, an image forming apparatus, and a sheet buffering device, which make it possible to maintain alignment of sheets of a sheet bundle on a processing tray even for a job which uses sheets including particular sheets, such as tab sheets.

In a first aspect of the present invention, there is provided a sheet processing apparatus that performs processing on sheets, comprising a conveying unit configured to convey sheets along a conveying path, a buffer unit configured to convey a first sheet and a second sheet following the first sheet as a sheet bundle conveyed by the conveying unit in a state where the second sheet is superimposed on the first sheet and shifted from the first sheet in a conveying direction, a stacking unit configured to stack the first and the second sheets as the sheet bundle conveyed by the buffer unit, a determination unit configured to determine in advance, before a sheet conveyed by the conveying unit reaches the buffer unit, whether the sheet is a particular sheet having a protrusion on a leading side thereof in the conveying direction, and a control unit configured to control a shift amount in which the second sheet is shifted from the first sheet when the first and the second sheets are conveyed by the buffer unit, according to a result of a determination by the determination unit.

In a second aspect of the present invention, there is provided an image forming apparatus that forms images on sheets, comprising a conveying unit configured to convey sheets along a conveying path, a buffer unit configured to convey a first sheet and a second sheet following the first sheet as a sheet bundle conveyed by the conveying unit in a state where the second sheet is superimposed on the first sheet and shifted from the first sheet in a conveying direction, a determination unit configured to determine in advance, before a sheet conveyed by the conveying unit reaches the buffer unit, whether the sheet is a particular sheet having a protrusion on a leading side thereof in the conveying direction, a stacking unit configured to stack the first and the second sheets as a sheet bundle, the particular sheet being stacked on the stacking unit such that the protrusion is positioned forward, and a control unit configured to control a shift amount in which the second sheet is shifted from the first sheet when the first and the second sheets are conveyed by the buffer unit according to a result of a determination by the determination unit.

In a third aspect of the present invention, there is provided a sheet buffering device for conveying sheets as a sheet bundle to a stacking unit, comprising a buffer unit configured to perform buffer processing for conveying a first sheet and a second sheet following the first sheet as the sheet bundle in a state where the second sheet is superimposed on the first sheet and shifted from the first sheet in a conveying direction, a determination unit configured to determine in advance, before a sheet to be conveyed to the stacking unit reaches the buffer unit, whether the sheet is a particular sheet having a protrusion on a leading side thereof in the conveying direction, and a control unit configured to control a shift amount in which the second sheet is shifted from the first sheet when the first and the second sheets are conveyed by the buffer unit, according to a result of a determination by the determination unit.

According to the present invention, in the case of buffering a particular sheet, such as a tab sheet, even when a tab portion of the sheet is detected, it is possible to convey the sheet to a processing tray while properly maintaining the sheet shift direction. Further, the present invention makes it possible to properly maintain alignment of the sheets of a sheet bundle on the processing tray even for a job which uses sheets including particular sheets, such as tab sheets.

The features and advantages of the invention will become more apparent from the following detailed description taken in conjunction with the accompanying drawings.

DETAILED DESCRIPTION OF THE EMBODIMENTS

The present invention will now be described in detail below with reference to the accompanying drawings showing an embodiment thereof.

Figure 1:
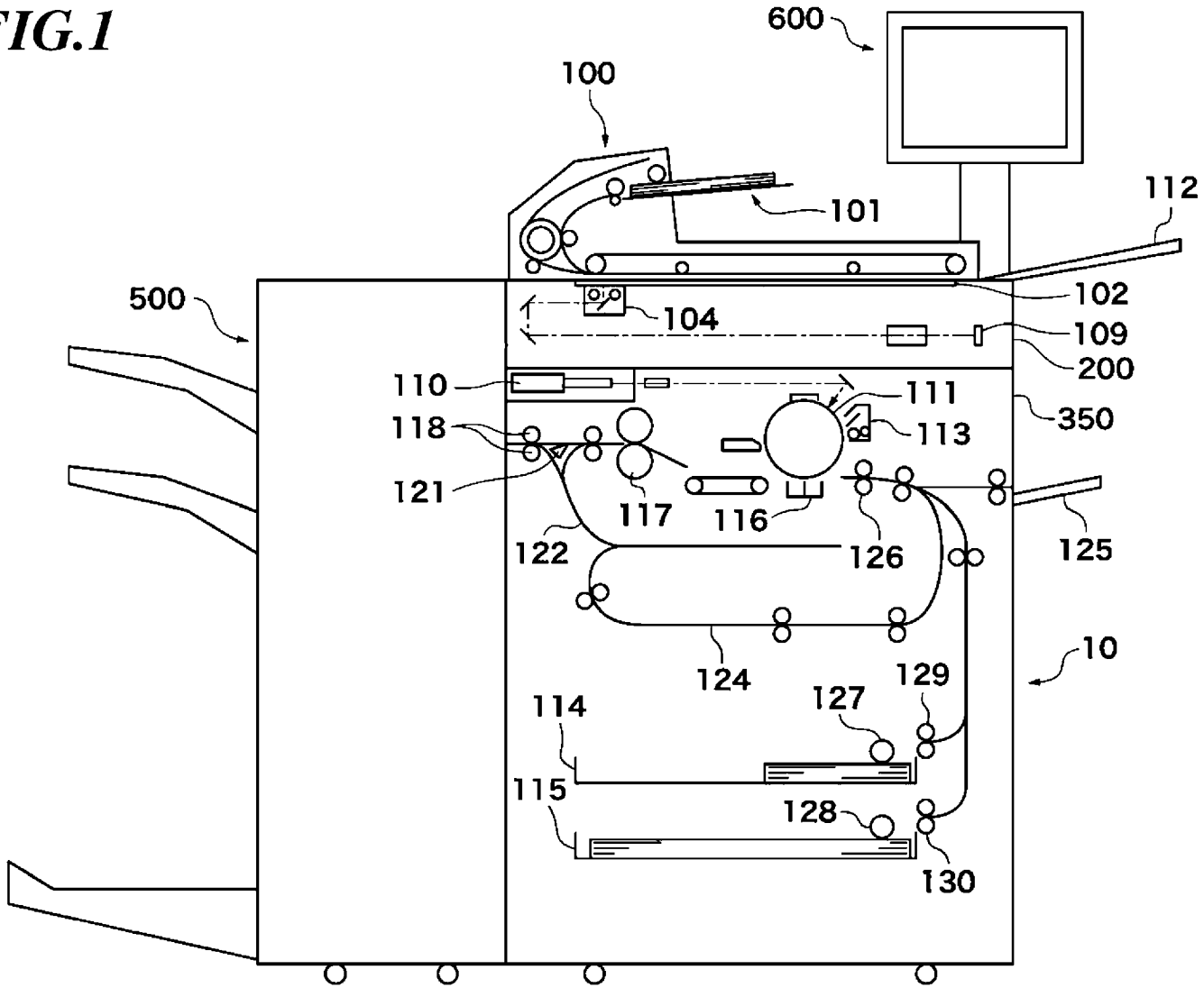
FIG. 1 is a schematic longitudinal cross-sectional view of an image forming system including an image forming apparatus according to an embodiment of the present invention.

FIG. 1 is a schematic longitudinal cross-sectional view of an image forming system including an image forming apparatus according to the embodiment of the present invention.

Referring to FIG. 1, the image forming system comprises the image forming apparatus 10 and a finisher 500 connected downstream of the image forming apparatus 10. Although in the present embodiment, only the finisher 500 is connected to the image forming apparatus 10, another apparatus (e.g. a sheet feeder) may be connected to the image forming apparatus 10.

First, a description will be given of the arrangement and operation of the image forming apparatus 10.

The image forming apparatus 10 comprises an image reader 200 that reads an image from an original, and a printer 350 that forms the image read by the image reader 200 on a sheet.

A document feeder 100 of the image reader 200 sequentially feeds originals (pages of a document) set on a document tray 101 with their front surfaces facing upward, one by one from the leading page, such that the originals are conveyed through a reading position on a platen glass 102 toward an external discharge tray 112.

As each original passes the reading position on the platen glass 102, an image of the original is read by an image sensor 109.

The image read by the image sensor 109 is converted into image data and then input as a video signal to an exposure section 110 of the printer 350.

The exposure section 110 of the printer 350 modulates a laser beam based on the video signal input from the image reader 200 and then irradiates a photosensitive drum 111 with the modulated laser beam. On the photosensitive drum 111, an electrostatic latent image is formed according to the scanned laser beam. The electrostatic latent image formed on the photosensitive drum 111 is visualized as a developer image (toner image) by a developer supplied from a developing device 113.

On the other hand, a sheet fed from an upper cassette 114 or a lower cassette 115 of the printer 350 by an associated one of pickup rollers 127 and 128 is conveyed to a registration roller 126 by an associated one of sheet feed rollers 129 and 130. A sheet fed from a manual sheet feeder 125 is also conveyed to the registration roller 126. It should be noted that the cassette 114 or 115 or the manual sheet feeder 125 can contain tabbed sheets (tab sheets). When the leading edge of the sheet reaches the registration roller 126, the registration roller 126 is driven in predetermined timing to convey the sheet in between the photosensitive drum 111 and a transfer section 116. The developer image formed on the photosensitive drum 111 is transferred onto the fed sheet by the transfer section 116. The sheet having the developer image transferred thereon is conveyed to a fixing section 117. The fixing section 117 fixes the developer image on the sheet by heating and pressing the sheet. The sheet having passed through the fixing section 117 passes through a flapper 121 and a discharge roller pair 118 and is discharged from the printer 350 toward the external apparatus (i.e. the finisher 500).

When the sheet is to be discharged face-down, i.e. with an image-formed surface thereof facing downward, the sheet having passed through the fixing section 117 is temporarily guided into an inverting path 122 by switching operation of the flapper 121. Then, after the trailing edge of the sheet has passed through the flapper 121, the sheet is switched back and discharged from the printer 350 by the discharge roller pair 118. This sheet discharge mode is referred to as "inverted discharge". The inverted discharge is carried out in a case where images are sequentially formed starting with the leading page, e.g. when images read using the document feeder 100 are formed or when images output from a computer are formed. The sheets thus discharged by the inverted discharge are stacked in the correct page order.

Further, when a double-sided printing mode for forming images on both sides of a sheet is set, the sheet is guided into the inverting path 122 by switching operation of the flapper 121 and is then conveyed to the double-sided conveying path 124. Then, the sheet guided into the double-sided conveying path 124 is fed in again between the photosensitive drum 111 and the transfer section 116 in the above-mentioned timing.

An operation and display unit 600 includes a plurality of keys for configuring various functions for image forming operation, and a display section for displaying information indicative of setting, as referred to hereinafter with reference to FIG. 5A.

Next, the arrangement and operation of the finisher 500 will be described with reference to FIG. 2.

Figure 2:
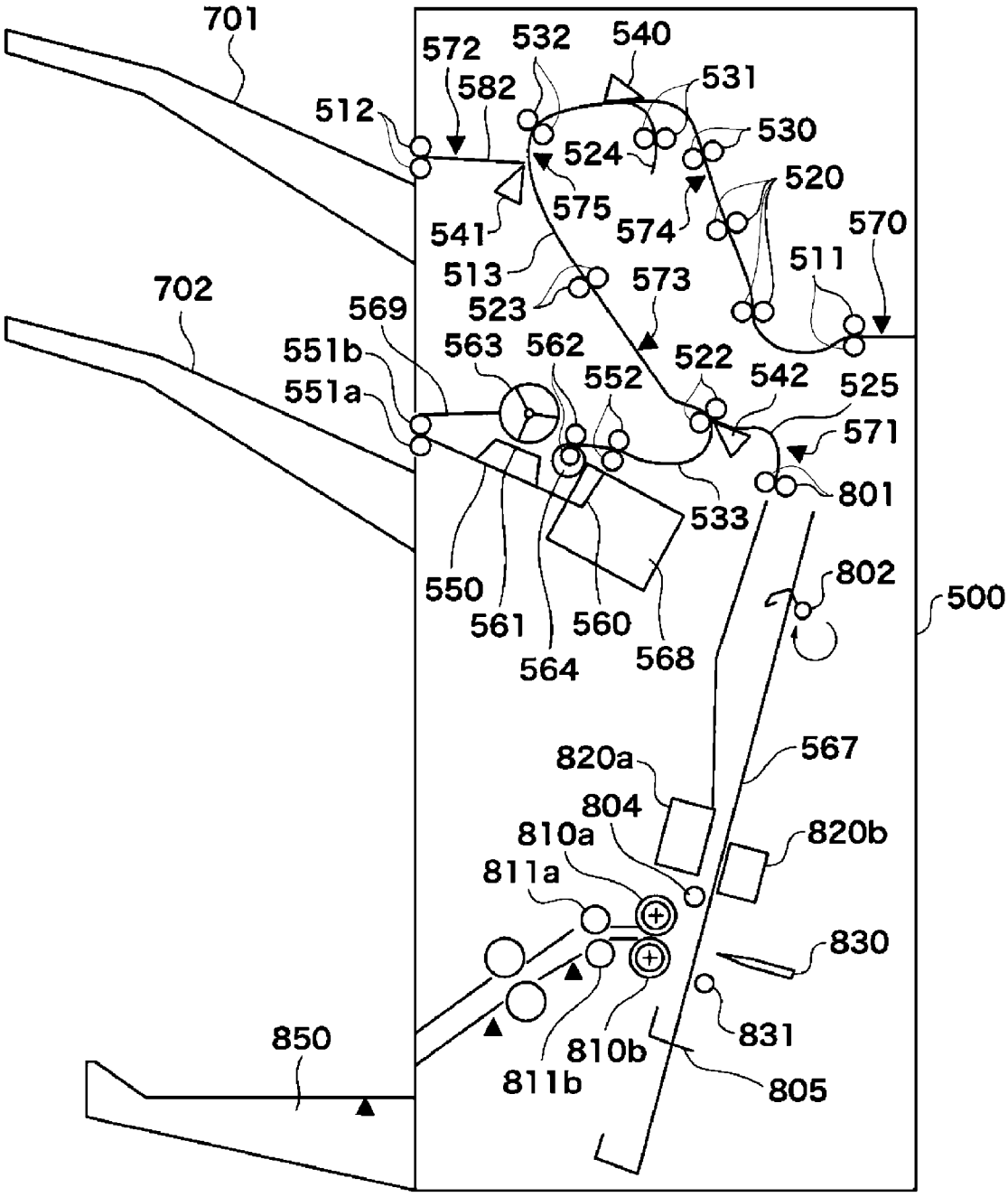
FIG. 2 is a schematic longitudinal cross-sectional view of a finisher appearing in FIG. 1.

FIG. 2 is a schematic longitudinal cross-sectional view of the finisher 500 appearing in FIG. 1.

The finisher 500 is a sheet processing apparatus that sequentially takes in sheets discharged from the image forming apparatus 10 and performs processing for aligning the taken-in sheets into a bundle. Further, the finisher 500 performs various types of processing, such as staple processing for stapling the trailing ends of bundled sheets, punching processing for punching holes in the trailing end of a taken-in sheet, sort processing, non-sort processing, and bookbinding processing.

As shown in FIG. 2, the finisher 500 takes in a sheet discharged from the image forming apparatus 10 by an inlet roller pair 511, and conveys the taken-in sheet toward a conveying roller pair 530 via a conveying roller pair 520. An inlet sensor 570 is disposed upstream of the inlet roller pair 511, and a punching unit (not shown) is disposed in a conveying path between the conveying roller pair 520 and the conveying roller pair 530. The punching unit is operated, as required, to punch holes in a sheet conveyed thereto in the vicinity of the trailing edge thereof.

A buffer roller pair 531 and a conveying roller pair 532 guide a sheet to be buffered into a buffer path 524 or into a non-sorting path 582 or a sorting path 513. A switching flapper 540 is a switching member for guiding a sheet into the buffer path 524.

When guiding a sheet retained in the buffer path 524 into the non-sorting path 582, the switching flapper 540 and a switching flapper 541 are switched toward the non-sorting path 582. The sheet guided into the non-sorting path 582 is discharged onto a sample tray 701 via a discharge roller pair 512. In an intermediate portion of the non-sorting path 582, there is disposed a sheet discharge sensor 572. A sheet retained in the buffer path 524 is guided into the sorting path 513 by switching the switching flapper 540 and the switching flapper 541 toward the sorting path 513. The sheet guided into the sorting path 513 is discharged onto a processing tray 550 by conveying roller pairs 523, 522, and 552.

At a downstream location of the sorting path 513, there is disposed a switching flapper 542. The switching flapper 542 is a switching member for guiding sheets into a sorting discharge path 533 or a bookbinding path 525. The sheets guided into the sorting discharge path 533 are stacked on the processing tray 550 via a conveying roller pair 562. The sheets stacked on the processing tray 550 as a bundle are subjected to alignment processing by alignment members 561, staple processing, and so forth, as required, and then are discharged onto a stack tray 702 by a bundle discharge roller pair 551 (551*a* and 551*b*). It should be noted that the alignment members 561 are disposed as a pair on the front and rear sides, as viewed in FIG. 2, respectively.

The bundle discharge roller 551*b* is supported by a swinging guide 569. The swinging guide 569 is swung by a swinging motor (not shown) to bring the bundle discharge roller 551*b* into contact with the top sheet of a sheet bundle on the processing tray 550. When in contact with the top sheet on the processing tray 550, the bundle discharge roller 551*b* cooperates with the bundle discharge roller 551*a* to discharge the sheet bundle from the processing tray 550 toward the stack tray 702. A paddle 563 and a knurled belt 564 are assist members for moving the sheet bundle.

The staple processing is performed by a stapler 568. The stapler 568 is configured to be movable along the outer periphery of the processing tray 550. The stapler 568 binds bundled sheets stacked on the processing tray 550 in the trailing end (rear end) thereof with respect to the sheet conveying direction. The processing tray 550 is formed with a stopper 560 with which the trailing edge of a sheet stacked on the processing tray 550 comes into abutment.

Further, the sheet guided into the bookbinding path 525 is conveyed to a bookbinding tray 567 via a conveying roller pair 801. In an intermediate portion of the bookbinding path 525, there is provided a bookbinding inlet sensor 571.

The bookbinding tray 567 is provided with a sheet positioning member 804 and a leading edge-aligning member 805. An anvil 820*b* is provided at a location opposed to two pairs of staplers 820*a*, and the staplers 820*a* and the anvil 820*b* cooperate to perform staple processing on a bundle of sheets received in the bookbinding tray 567. A sheet separation roller 831 for separating sheets from the bookbinding tray 567 is disposed on the rear surface of the bookbinding tray 567. Further, the bookbinding tray 567 has an upper portion, as viewed in FIG. 2, provided with a sheet holding member 802 for holding sheets.

A folding roller pair 810 (810*a*, 810*b*) and a thrusting member 830 are disposed downstream of the staplers 820*a*. The thrusting member 830 is disposed at a location opposed to the folding roller pair 810. The thrusting member 830 is caused to protrude toward a sheet bundle received in the bookbinding tray 567, whereby the sheet bundle is pushed toward a nip between the folding roller pair 810. The folding roller pair 810 folds the sheet bundle pushed into the nip and conveys the same downstream. The folded sheet bundle is discharged onto a bookbinding tray 850 via a bundle discharge roller pair 811 (811*a*, 811*b*).

On the sheet conveying path, there are disposed path sensors 573, 574, and 575 and so forth for detecting passage of sheets.

Next, a description will be given, with reference to FIG. 3, of the configuration of a control section that controls the overall operation of the image forming system in FIG. 1.

Figure 3:
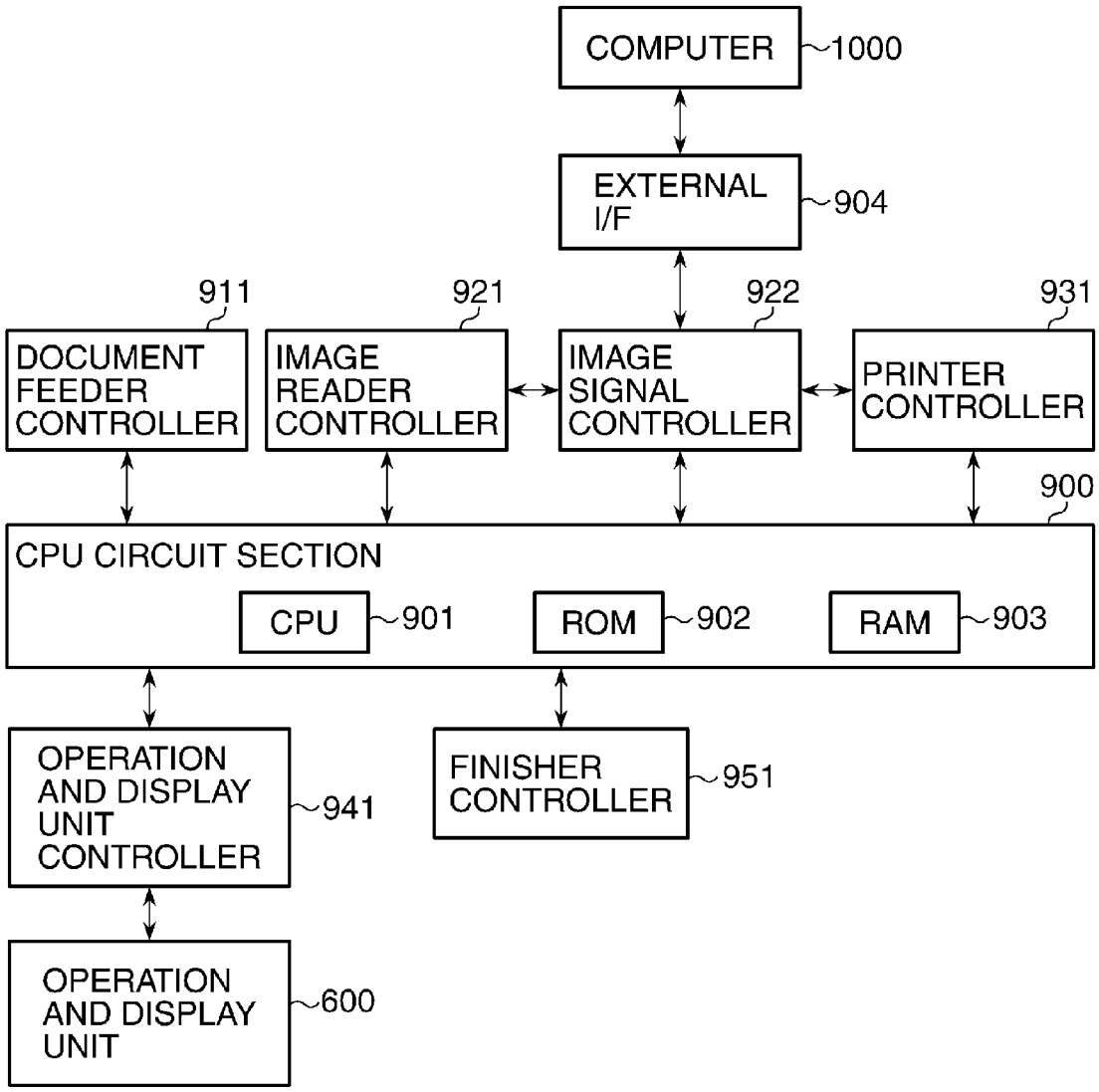
FIG. 3 is a schematic block diagram of a control section that controls the overall operation of the image forming system in FIG. 1.

FIG. 3 is a schematic block diagram of the control section.

As shown in FIG. 3, the control section includes a CPU circuit section 900 incorporating a CPU 901, a ROM 902, and a RAM 903. The CPU 901 controls the overall basic operation of the present image forming system, and the ROM 902 in which control programs are written and the RAM 903 for use in executing processing are connected to the CPU 901 by an address bus and a data bus, both not shown. The CPU 901 performs centralized control of controllers 911, 921, 922, 931, 941, and 951 and an external interface 904 by executing control programs stored in the ROM 902. The RAM 903 temporarily stores control data, and is also used as a work area for carrying out arithmetic operations involved in control processing.

The document feeder controller 911 drivingly controls the document feeder 100 according to instructions from the CPU circuit section 900. The image reader controller 921 drivingly controls a scanner unit 104, the image sensor 109, and so forth, and transfers an image signal output from the image sensor 109 to the image signal controller 922.

The image signal controller 922 converts the analog image signal from the image sensor 109 into a digital signal, then performs various kinds of processing on the digital signal, converts the processed digital signal to a video signal, and then delivers the video signal to the printer controller 931. Further, the image signal controller 922 performs various kinds of processing on a digital image signal input from a computer 1000 via the external interface 904, converts the processed digital image signal to a video signal, and then delivers the video signal to the printer controller 931. The processing operations executed by the image signal controller 922 are controlled by the CPU circuit section 900.

The printer controller 931 controls the exposure section 110 and the printer 350 based on the received video signal to perform image formation and sheet conveyance.

The finisher controller 951 is incorporated in the finisher 500, and exchanges information with the CPU circuit section 900 to thereby control the overall operation of the finisher 500. In short, the image forming apparatus 10 and the finisher 500 are communicably connected to each other.

The operation and display unit controller 941 controls exchange of information between the operation and display unit 600 and the CPU circuit section 900. The operation and display unit 600 outputs key signals corresponding to respective operations of keys to the CPU circuit section 900, and displays the corresponding pieces of information based on signals from the CPU circuit section 900.

Next, a description will be given, with reference to FIG. 4, of the schematic configuration and control operation of the finisher controller 951 appearing in FIG. 3.

Figure 4:
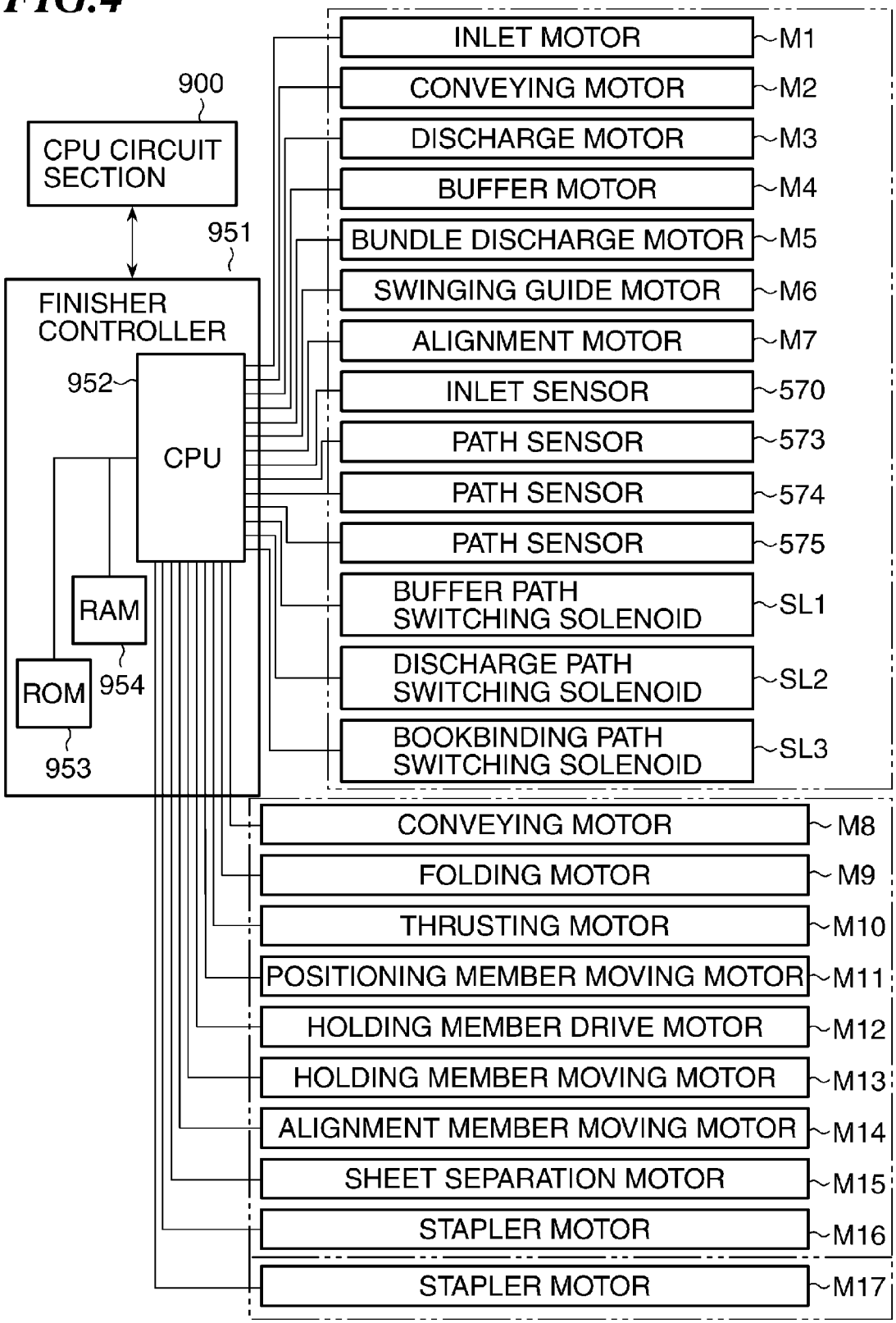
FIG. 4 is a schematic block diagram of a finisher controller of the finisher in FIG. 2 and functional blocks controlled by the finisher controller.

FIG. 4 is a schematic block diagram of the finisher controller 951 of the finisher 500 in FIG. 2 and functional blocks controlled by the finisher controller 951.

As shown in FIG. 4, the finisher controller 951 comprises a CPU 952, a ROM 953, and a RAM 954. The finisher controller 951 communicates with the CPU circuit section 900 provided in the image forming apparatus 10 via a communication IC, not shown, for data exchange, and executes various programs stored in the ROM 953 to drivingly control the finisher 500 according to instructions from the CPU circuit section 900.

Next, a description will be given of various inputs and outputs to and from the CPU 952.

The CPU 952 outputs control signals to an inlet motor M1 for driving the inlet roller pair 511 and the conveying roller pair 520, a conveying motor M2 for driving the conveying roller pair 530, and a discharge motor M3 for driving the discharge roller pair 512 and the conveying roller pair 523. Further, the CPU 952 outputs a control signal to a buffer motor M4 for driving the buffer roller pair 531 and the conveying roller pair 532.

Furthermore, the CPU 952 functions as a unit for driving the various members associated with the processing tray 550, and outputs control signals to a bundle discharge motor M5 for driving the bundle discharge roller pair 551, a swinging guide motor M6 for lifting up and down the swinging guide 569, and an alignment motor M7 for driving the alignment members 561. The CPU 952 receives input signals from the inlet sensor 570 and the path sensors 573, 574, and 575, each for detecting passage of a sheet, and so forth.

The CPU 952 outputs control signals to a buffer path switching solenoid SL1 for driving the switching flapper 540, a discharge path switching solenoid SL2 for driving the switching flapper 541, and a bookbinding path switching solenoid SL3 for driving the switching flapper 542.

The CPU 952 outputs control signals to a conveying motor M8 for driving the conveying roller pair 801, a folding motor M9 for driving the folding roller pair 810, and a thrusting motor M10 for driving the thrusting member 830, as outputs for the function of bookbinding. Further, the CPU 952 outputs control signals to a positioning member moving motor M11 for separating the sheet positioning member 804 from the bookbinding tray 567 or bringing the sheet positioning member 804 into contact with the bookbinding tray 567, and a holding member drive motor M12 for driving the sheet holding member 802.

Furthermore, the CPU 952 outputs control signals to a sheet holding member-moving motor M13 for moving the sheet holding member 802, an alignment member moving motor M14 for moving the leading edge-aligning member 805, and a sheet separation motor M15 for driving the sheet separation roller 831. The CPU 952 also outputs control signals to a stapler motor M16 for driving the stapler 568 and a stapler motor M17 for driving the stapler 820*a*.

Next, a description will be given, with reference to FIGS. 5A to 5C and 6A to 6D, of the outline of the operation and display unit 600 and a method of setting a sorting mode.

Figure 5A:
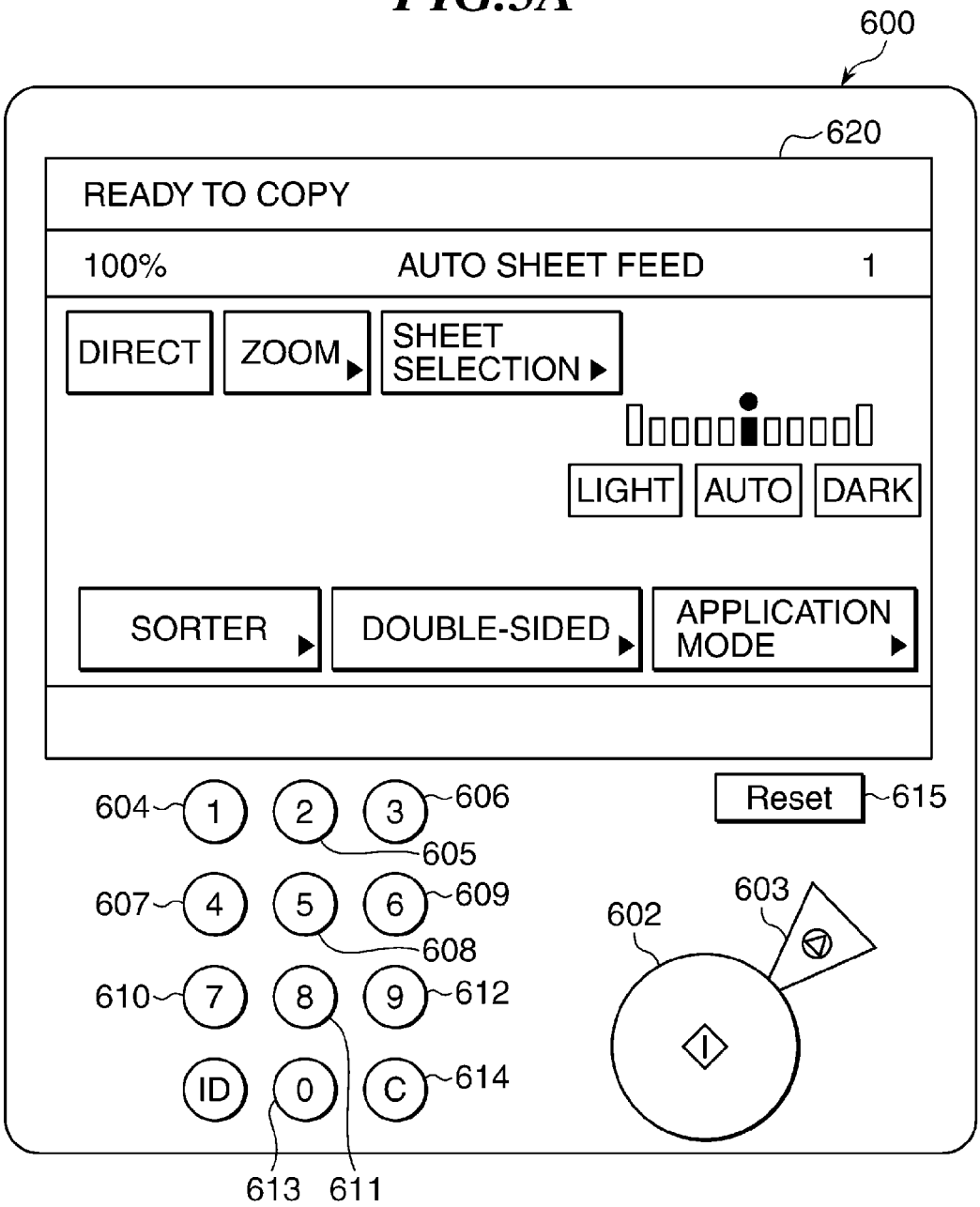
FIGS. 5A to 5C are views illustrating a first example of transition of a display screen displayed when a sorting mode is to be set on an operation and display unit.

FIG. 5A is a view of the appearance of the operation and display unit 600 of the image forming apparatus 10. FIGS. 5B and 5C and 6A to 6D illustrate an example of transition of a display screen displayed when a sorting mode is to be set on the operation and display unit 600.

Referring to FIG. 5A, on the operation and display unit 600, there are arranged a start key 602 for starting image forming operation, a stop key 603 for interrupting the image forming operation, a ten-key numeric keypad including keys 604 to 613 for numerical entries, a clear key 614, a reset key 615, and so forth. Further, the operation and display unit 600 includes a display section 620 having a touch panel formed on the surface thereof, where an application mode key and other keys are provided.

Figure 5B:
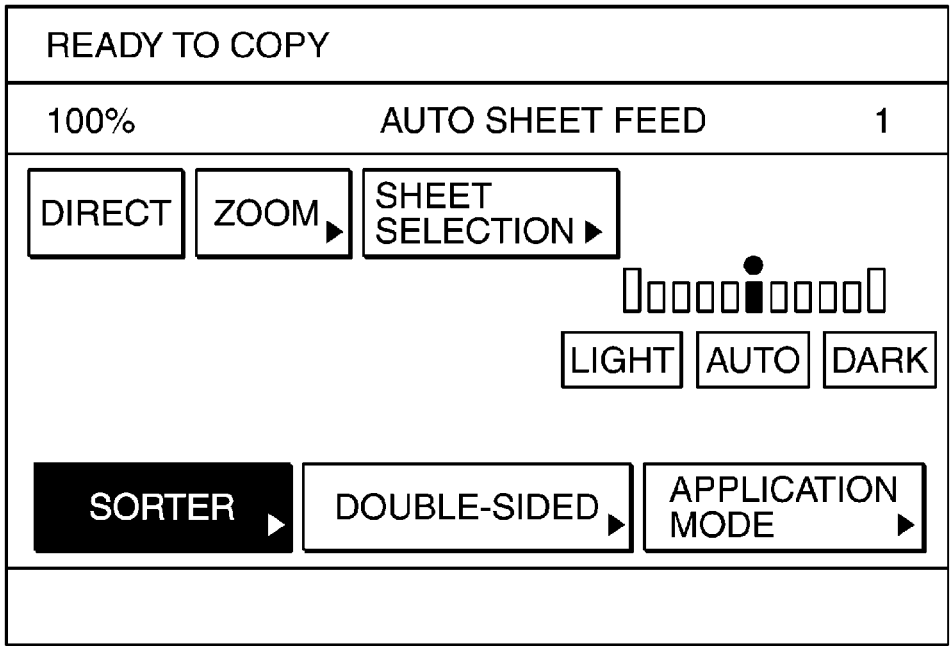
Figure 5C:
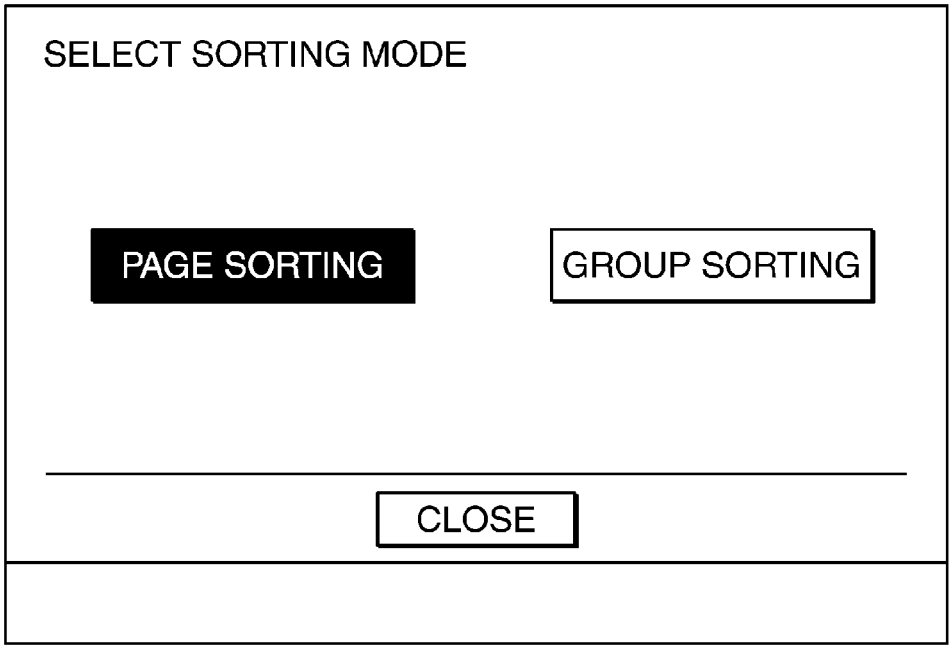

First, when a soft key "sorter" is selected on an initial screen illustrated in FIG. 5B, the display section 620 is switched to a screen, illustrated in FIG. 5C, for use in selecting one of modes. An operator selects one of keys "page sort" and "group sort" on this screen to designate a sorting mode, whereby the sorting mode setting is completed.

Figure 6A:
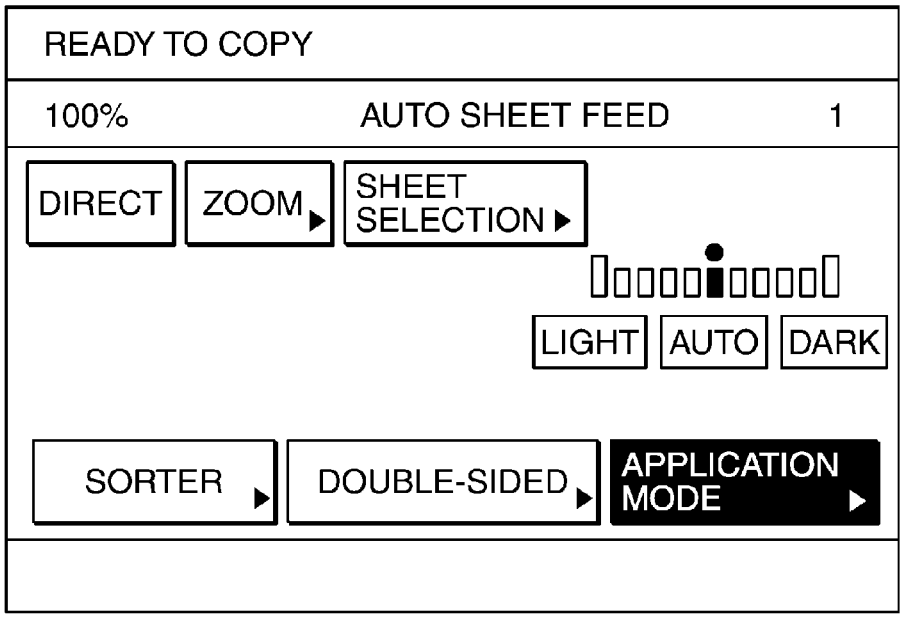
FIGS. 6A to 6D are views illustrating a second example of transition of a display screen displayed when a sorting mode is to be set on the operation and display unit.
Figure 6B:
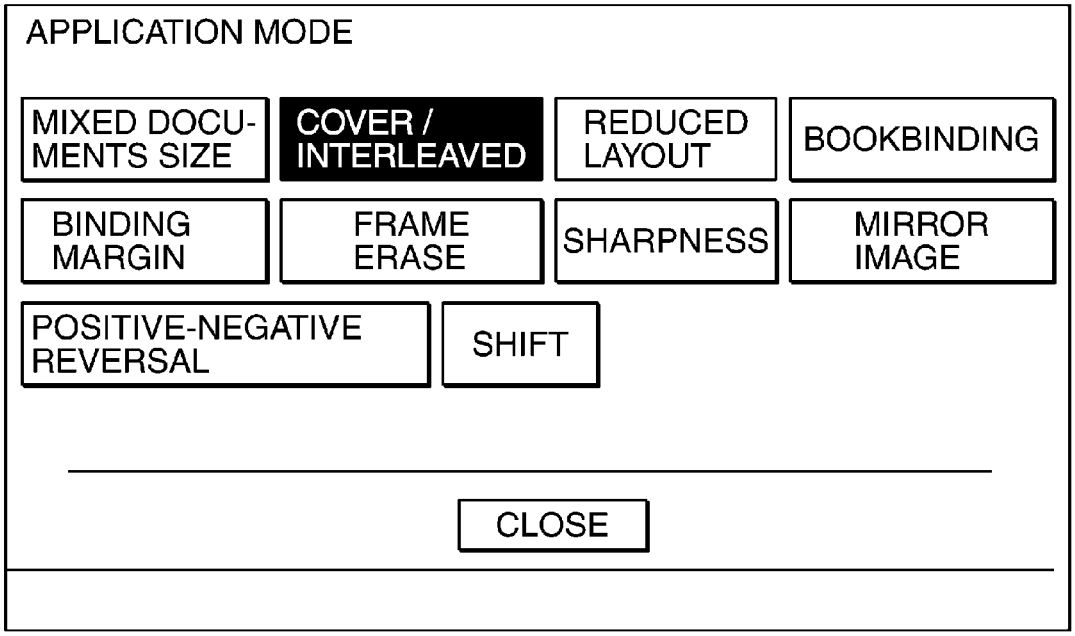
Figure 6C:
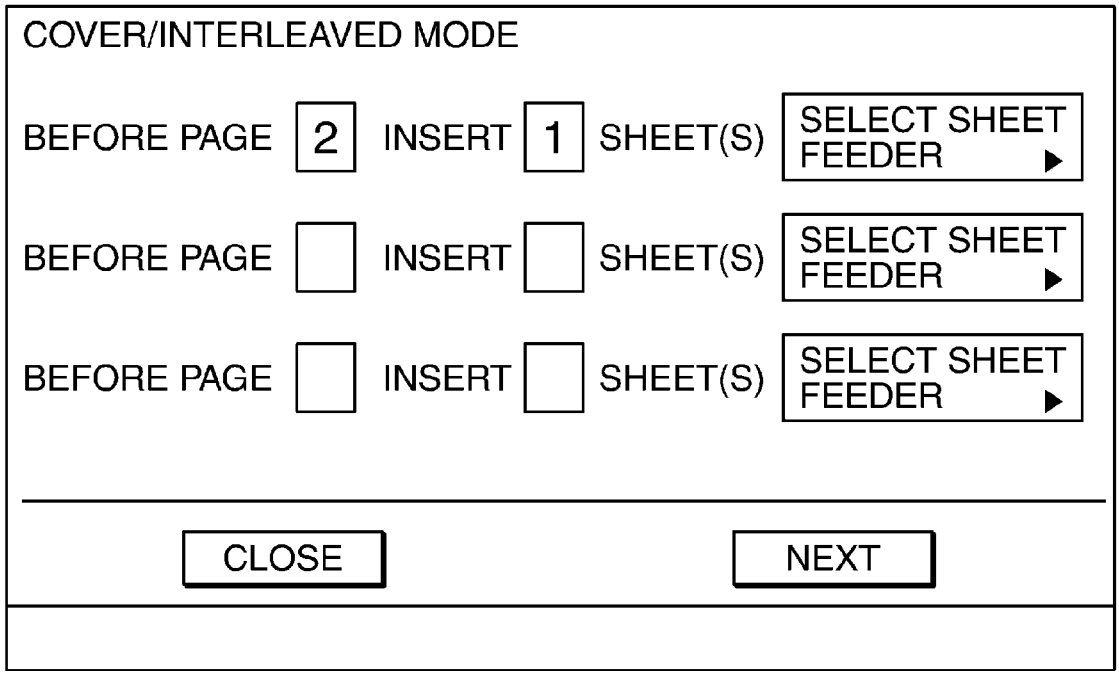
Figure 6D:
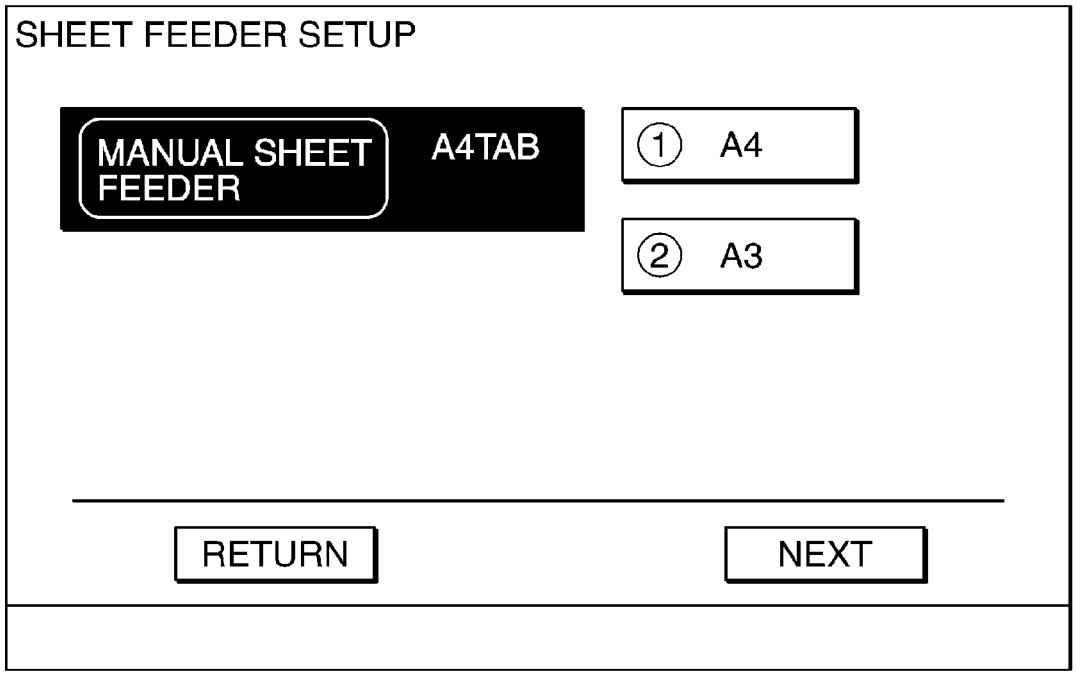

In a case where interleaved sheets, such as tab sheets, are to be inserted in a job in the sorting mode, the operator selects a soft key "application mode" on the initial screen as illustrated in FIG. 6A. Then, the display section 620 is switched to a screen, illustrated in FIG. 6B, for use in selecting one of various modes. When a "cover/interleaved" key is selected, the display section 620 is switched to a screen illustrated in FIG. 6C. On this screen, it is possible to determine how many cover or interleaved sheets are to be inserted between what pages. Then, when a "sheet feeder selection" key is selected, the display section 620 is switched to a screen illustrated in FIG. 6D. On this screen, it is possible to select a sheet feeder to feed cover or interleaved sheets. In the present embodiment, it is assumed that tab sheets are set in the manual sheet feeder 125.

Next, a description will be given, with reference to FIGS. 7A to 7C, of how sheets flow in the finisher 500 in the sorting mode in a case where a print set is formed by a sheet bundle of three sheets.

Figure 7A:
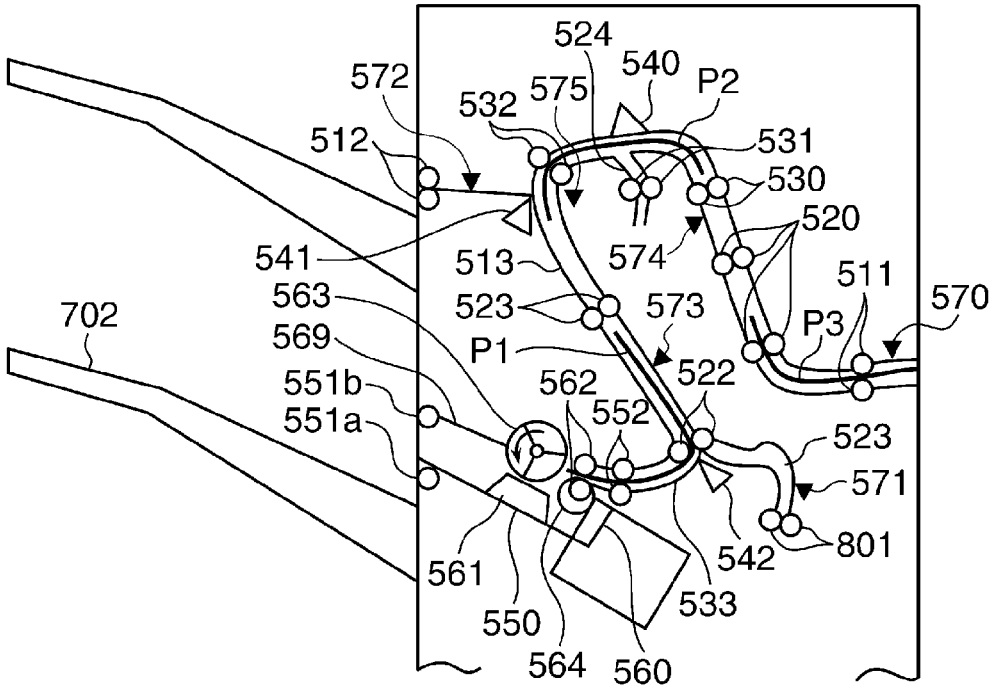
FIGS. 7A to 7C are schematic partial cross-sectional views useful in explaining a sorting process executed in the finisher.
Figure 7B:
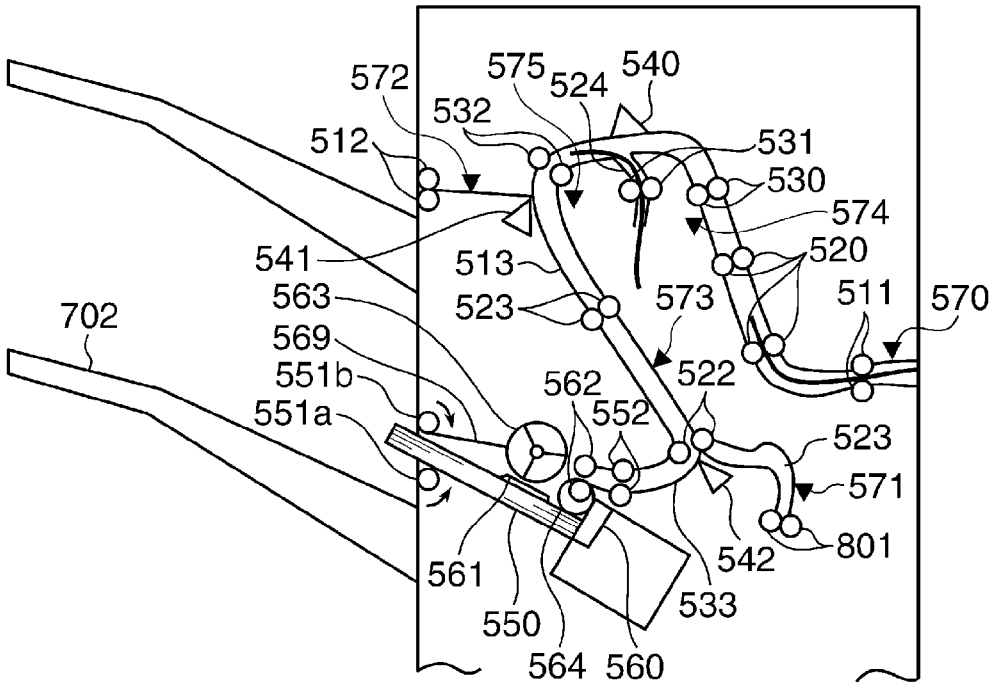
Figure 7C:
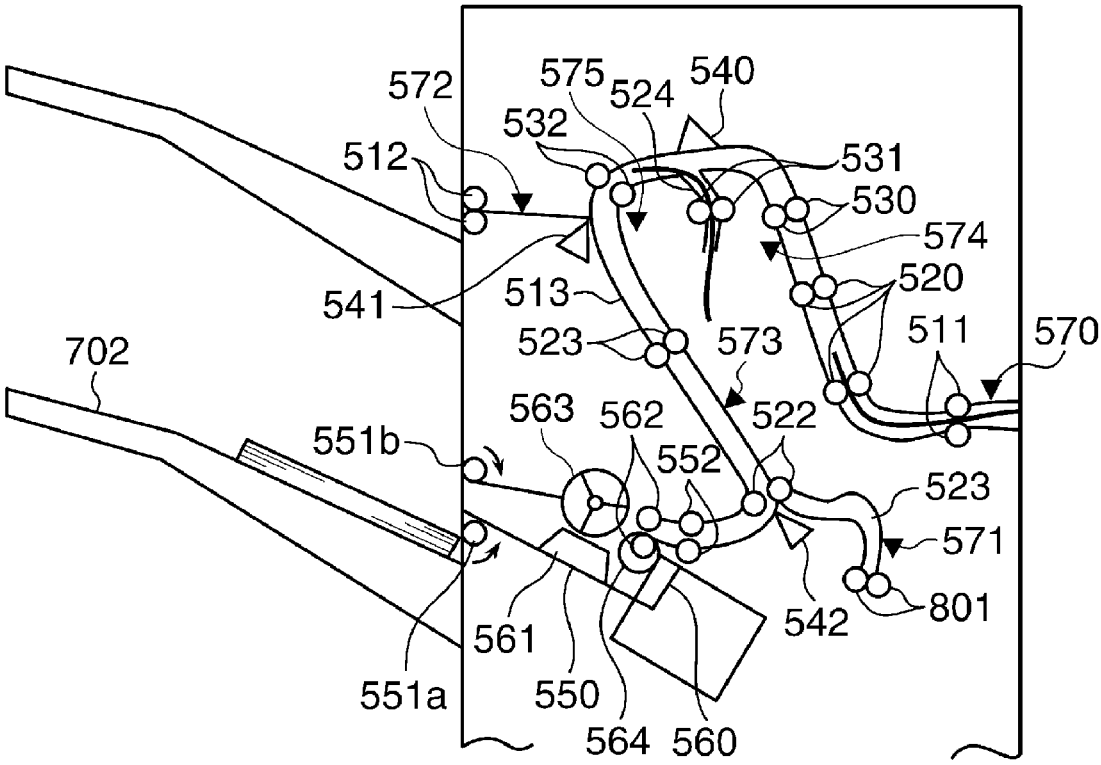

FIGS. 7A to 7C are schematic partial cross-sectional views useful in explaining a sorting process executed by the finisher 500.

When a job for which a sorting mode has been designated by the user is input, similarly to the case of a non-sorting mode, the CPU 901 of the CPU circuit section 900 notifies the CPU 952 of the finisher controller 951 that the sorting mode has been selected. Then, before a sheet is discharged from the image forming apparatus 10 to the finisher 500, the CPU 901 of the CPU circuit section 900 notifies the CPU 952 of the finisher controller 951 that passing of the sheet is started.

When notified of the start of the passing of the sheet, the CPU 952 drives the inlet motor M1 and the conveying motor M2, whereby the inlet roller pair 511 and the conveying roller pairs 520, 530, and 532 are driven for rotation, as shown in FIG. 7A. Thus, sheets P1, P2, and P3 discharged from the image forming apparatus 10 are taken into the finisher 500 and conveyed in the same. The switching flappers 540 and 541 are held in respective positions shown in FIG. 7A, so that the sheet P1 is guided into the sorting path 513. The sheet P1 guided through the sorting path 513 is conveyed by the conveying roller pairs 523, 522, and 552 to be discharged onto the processing tray 550.

The CPU 952 detects that the sheet P1 has been advanced by a predetermined length after the path sensor 573 detecting the trailing edge of the sheet P1, thereby detecting that the sheet P1 has been discharged onto the processing tray 550. The sheet P1 discharged onto the processing tray 550 starts to be moved toward the stopper 560 on the processing tray 550 by its own weight. Such movement of a sheet is assisted by assist members, including the paddle 563 and the knurled belt 564.

After the trailing end of the sheet P1 abuts against the stopper 560 and the sheet P1 stops, the alignment motor M7 is driven to cause the alignment members 561 to perform discharged sheet alignment. Similarly, the sheets P2 and P3 are sequentially stacked onto the processing tray 550. Thereafter, the swinging guide motor M6 is driven to lower the swinging guide 569 as shown in FIG. 7B, whereby a bundle discharge operation is carried out by sandwiching the bundle of sheets P between the bundle discharge roller pair 551, i.e. the bundle discharge rollers 551*a* and 551*b*, to discharge the sheet bundle P onto the stack tray 702. The sheet bundle P is formed such that a leading page is placed at the bottom thereof, with its image-formed surface facing downward and the following pages sequentially stacked on the leading page in page order. Sheet bundles are sequentially stacked on the stack tray 702 (see FIG. 7C).

In the sorting mode, a sheet bundle is discharged onto the stack tray 702 not after all sheets to form a copy have been stacked onto the processing tray 550, but when the number of sheets stacked on the processing tray 550 reaches a predetermined number N (hereinafter referred to as "the interim stacked sheet count N").

In the present embodiment, the predetermined number N is set to five. For example, when the number of sheets for one copy is ten, sheet bundle discharge is performed each time five sheets are stacked on the processing tray 550, that is, one copy of sheets is discharged by performing sheet bundle discharge twice. When the number of sheets for one copy is less than five, sheet bundle discharge is performed immediately after a final sheet is stacked onto the processing tray 550.

Next, a description will be given, with reference to FIGS. 8A to 8D, of a buffer operation for conveying a sheet bundle in a state in which a leading sheet and the following sheet are superimposed one upon the other.

FIGS. 8A to 8D are schematic partial cross-sectional views useful in explaining the buffer operation in the finisher 500.

Figure 8A:
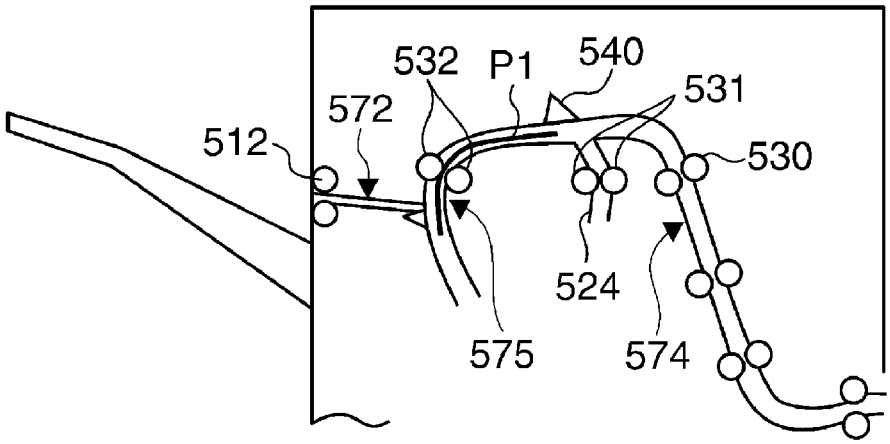
FIGS. 8A to 8D are schematic partial cross-sectional views useful in explaining a buffer operation performed in the finisher.

As shown in FIG. 8A, the sheet P1 as the first page of the sheet bundle discharged from the image forming apparatus 10 is advanced from the path sensor 575 by a predetermined distance, and is then stopped.

Figure 8B:
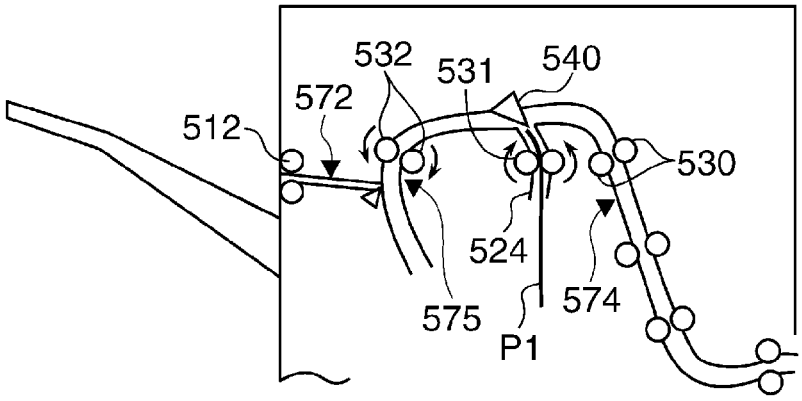

Then, the switching flapper 540 is switched by the buffer path switching solenoid SL1 as shown in FIG. 8B, and the buffer roller pair 531 and the conveying roller pair 532 are driven for reverse rotation by reverse driving of the buffer motor M4, whereby the sheet P1 is guided into the buffer path 524. The buffer motor M4 stops after having performed reverse rotation by a predetermined amount, and the sheet P1 is retained in the buffer path 524.

Figure 8C:
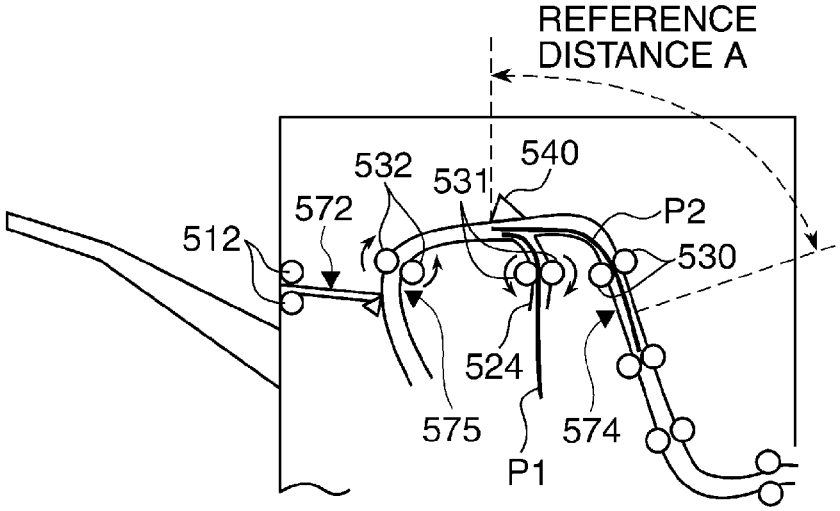
Figure 8D:
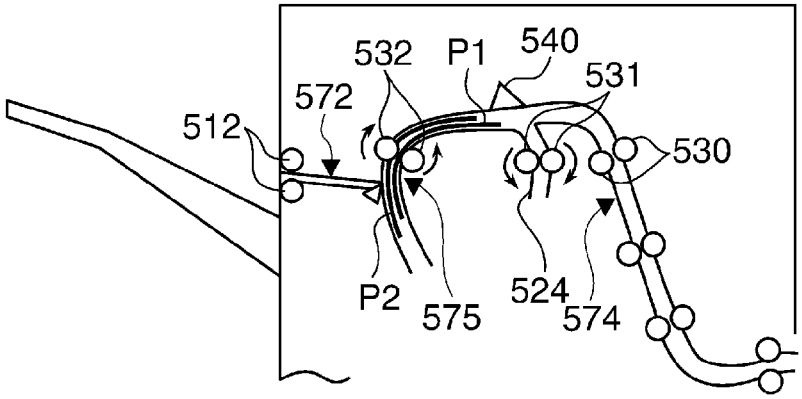

Then, the switching flapper 540 is switched by the buffer path switching solenoid SL1 as shown in FIG. 8C, and the buffer roller pair 531 and the conveying roller pair 532 are driven for rotation by driving of the buffer motor M4 in timing in which the following sheet P2 has been conveyed by a reference distance A [mm] after detection of the leading edge of the next-page sheet P2 by the path sensor 574. As a consequence, the sheet P1 is superimposed upon the sheet P2 as shown in 8D. At this time, the sheets P1 and P2 to be conveyed in a state superimposed one upon the other are conveyed with the sheet P2 shifted downstream from the sheet P1 in the conveying direction. Thereafter, the sheets P1 and P2 superimposed one upon the other are stacked on the processing tray 550.

Next, a description will be given, with reference to FIGS. 9A to 9D, of alignment of the sheets of the sheet bundle stacked on the processing tray 550 by the sheet conveying operation and the sheet tacking operation on the processing tray 550 during the sorting process executed by the CPU 952.

FIGS. 9A to 9D are views useful in explaining a method of aligning the sheets of a sheet bundle stacked on the processing tray 550.

Figure 9A:
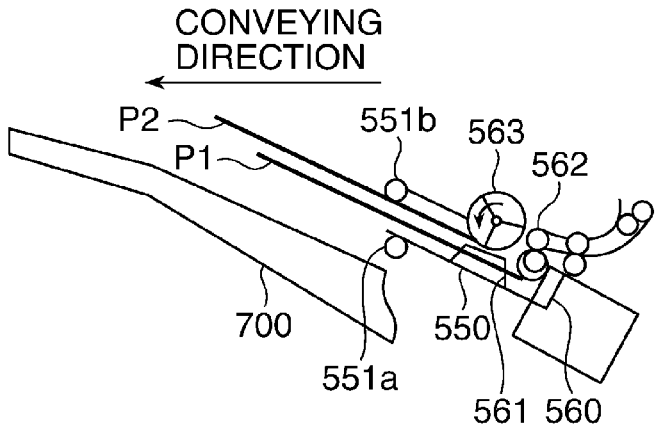
FIGS. 9A to 9D are views useful in explaining a method of aligning sheets of a sheet bundle on a processing tray.
Figure 9B:
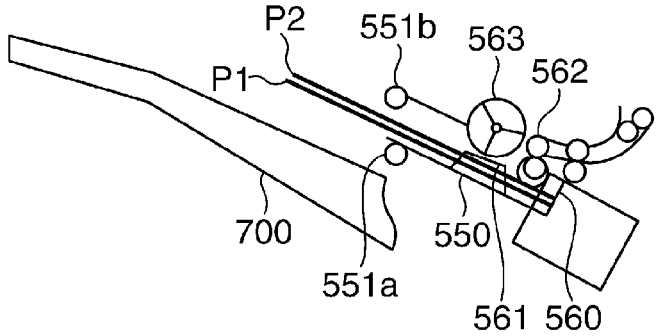

Referring to FIG. 9A, when the sheets P1 and P2 of the sheet bundle P, superimposed one upon the other, by the buffer operation are discharged onto the processing tray 550, the sheet bundle P starts to move toward the stopper 560 on the processing tray 550 by its own weight. At the same time, the sheet P2 on the top of the sheet bundle is assisted by the assist members, such as the paddle 563 and the knurled belt 564. On the other hand, the sheet P1 is conveyed toward the stopper 560 only by its own weight. At this time, if the sheet P2 is in a state properly shifted from the sheet P1 downstream in the conveying direction as shown in FIG. 9A, the sheets P1 and P2 are both properly brought into abutment with the stopper 560 by the weight of the sheet bundle P and the operations of the assist members as shown in FIG. 9B, whereby the sheet alignment operation is normally completed.

Figure 9C:
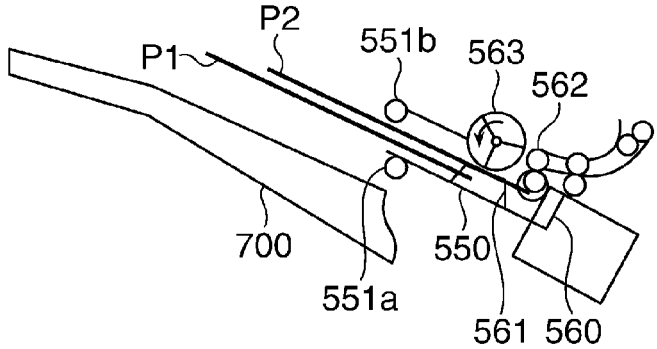
Figure 9D:
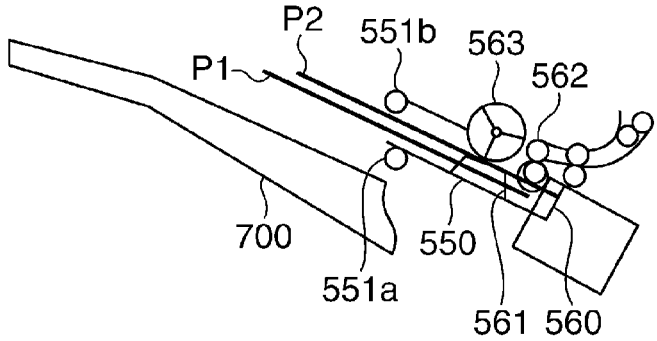

On the other hand, if the sheet alignment operation starts to be performed in a state in which the sheet P2 is shifted upstream from the sheet P1, as shown in FIG. 9C, the sheet P2 is properly brought into abutment with the stopper 560, but the sheet P1 is kept from contact with the same, as shown in FIG. 9D. This makes it impossible to align the sheets of the sheet bundle. Therefore, as mentioned hereinbefore, it is required to execute superposition control in consideration of alignment of the sheets of the sheet bundle on the processing tray 550, such that the relationship in the shift direction between the sheets P1 and P2 can be assured.

Figure 10A:
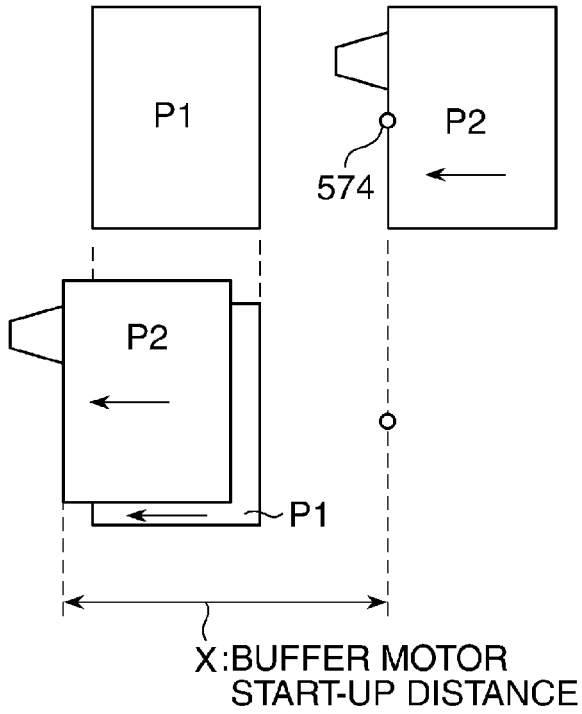
FIGS. 10A and 10B are top views illustrating the positional relationship between a sheet P1 retained by a buffer holding operation and the following sheet P2, and a path sensor.
Figure 10B:
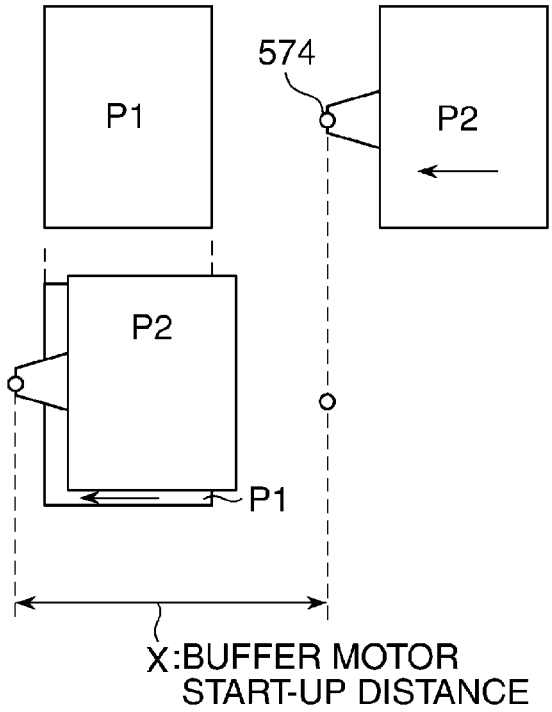

FIGS. 10A and 10B are top views showing the positional relationship between the sheet P1 retained by the buffer holding operation, the following sheet P2 to be conveyed in a state superimposed upon the sheet P1, and the path sensor 574 that functions as a conveyance trigger for the sheet P1 held in the buffer. It is assumed that the sheet P2 is a tab sheet, and is fed e.g. from the manual sheet feeder 125.

A description will be given of the outline of buffer superposition control in the present embodiment. Conveyance of the sheet P1 retained in the buffer is started in timing in which the sheet P2 has been conveyed by a start-up distance X [mm] after detection of the leading edge of the sheet P2 from the upstream apparatus by the path sensor 574. In this case, the start-up distance X is set such that the following sheet P2 is superimposed upon the sheet P1 in a manner shifted downstream from the sheet P1 in the conveying direction as illustrated in FIG. 10A.

However, if the path sensor 574 detects the tab portion of the sheet P2, the following sheet P2 is superimposed upon the sheet P1 in a state shifted upstream from the sheet P1 in the conveying direction as illustrated in FIG. 10B. If sheet bundle stacking processing is performed in this state, it is difficult to align the sheets of the sheet bundle, which results in degradation of the quality of a product.

To solve this problem, according to the present embodiment, in a case where a non-rectangular particular sheet, such as a tab sheet, having a non-straight leading edge is to be superimposed upon a plain sheet, the buffer superposition control is performed in different timing from the normal timing for superposition of plain sheets having a straight leading edge. It should be noted that a tab sheet is conveyed with its tab portion directed forward in the finisher 500 in consideration of alignment on the processing tray 550.

A description will be given, with reference to FIGS. 11 and 12A to 12C, of the buffer superposition control executed by the CPU 952 in the present embodiment, and a method of setting a buffer shift amount based on sheet information. In the present embodiment, it is assumed as a precondition that the sheet P1 is waiting in the buffer path 524 as illustrated in FIG. 8B. Further, the description is given assuming that the number of sheets to be superimposed and conveyed is 2.

Figure 11:
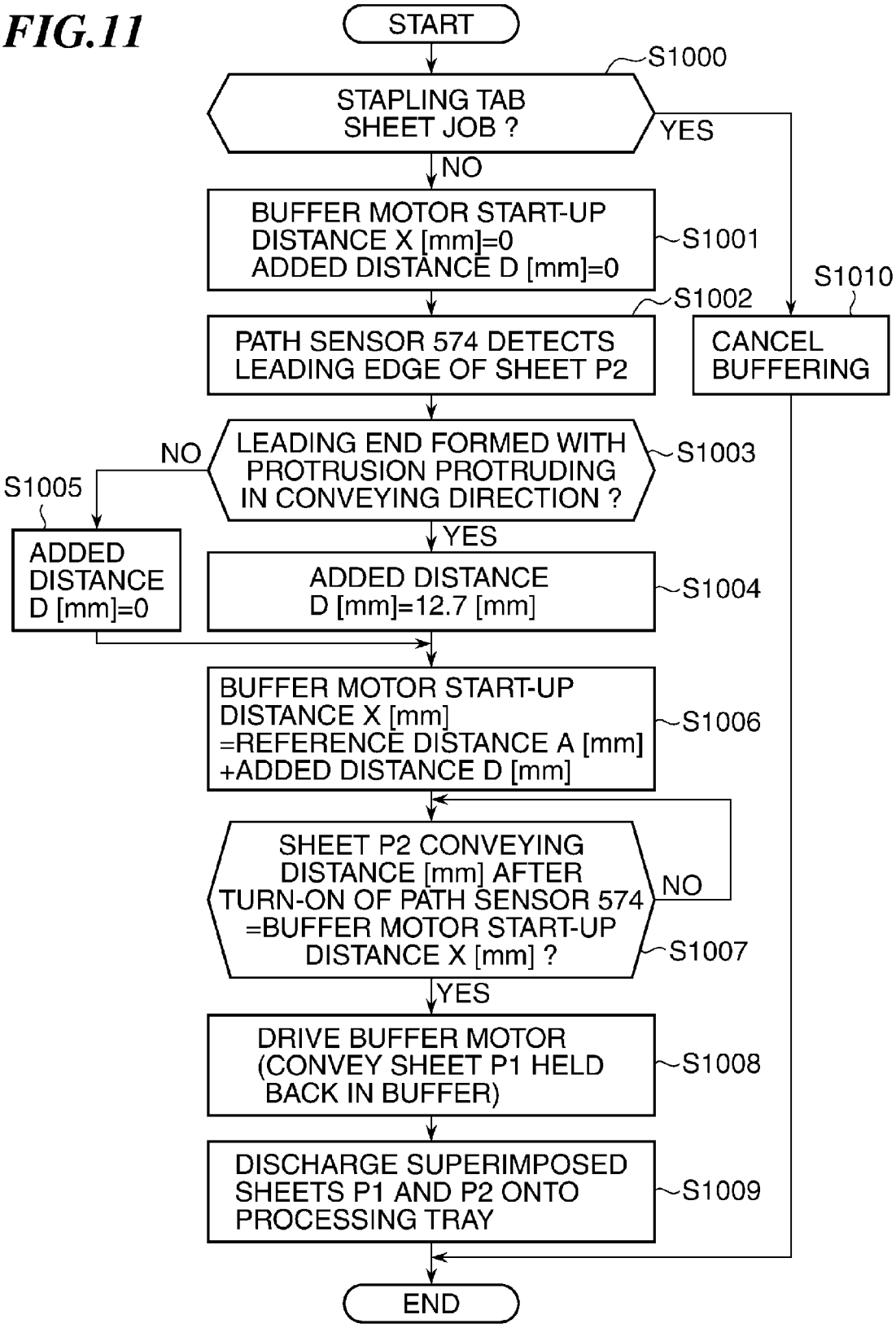
FIG. 11 is a flowchart of a buffer superposition control process.
Figure 12A:
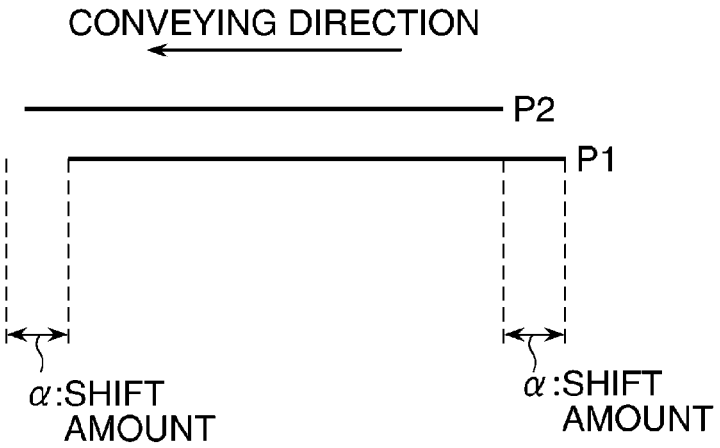
FIGS. 12A to 12C are views useful in explaining a method of setting a buffer shift amount.
Figure 12B:
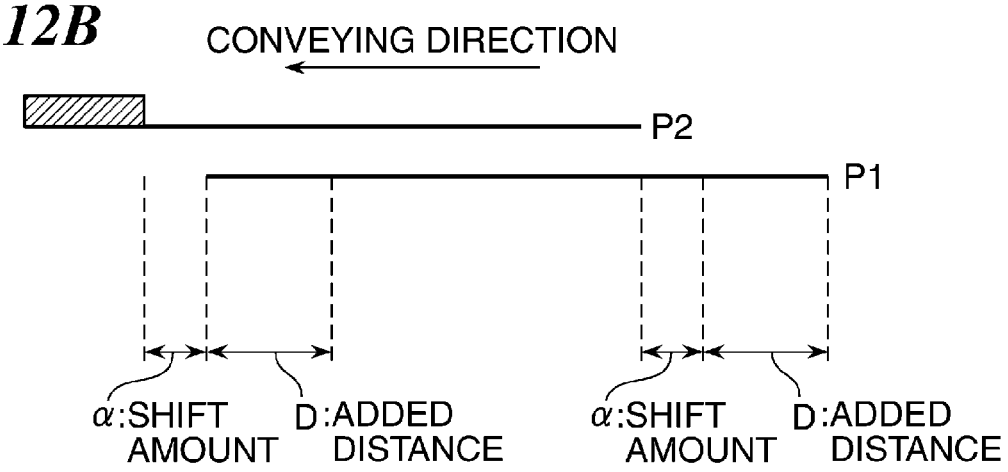
Figure 12C:
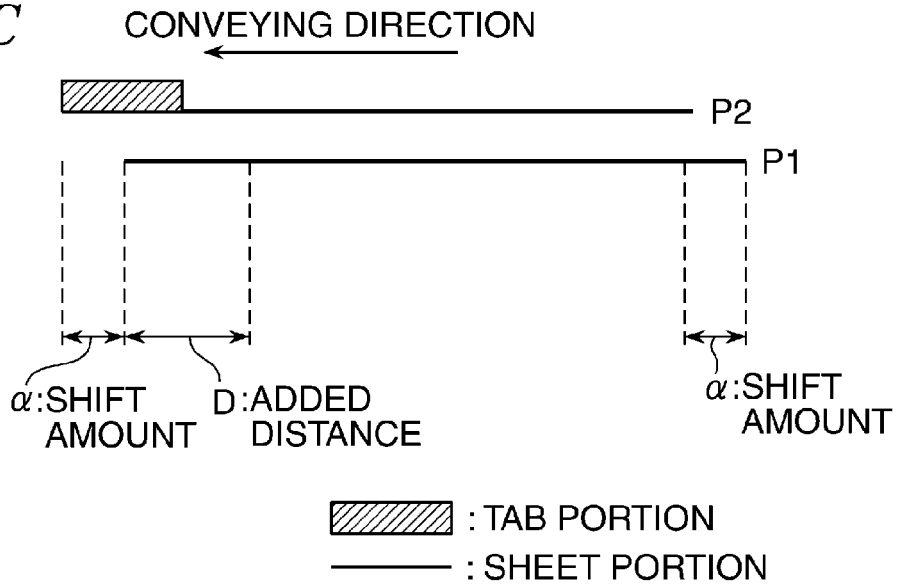

FIG. 11 is a flowchart of an example of the buffer superposition control process. FIGS. 12A to 12C are views useful in explaining the buffer shift amount setting method. The buffer superposition control process is executed by the CPU 952 of the finisher controller 951.

In a step S1000, the CPU 952 of the finisher controller 951 determines whether or not sheets from the top of a sheet bundle to a predetermined number-th sheet include a tab sheet and the staple processing has been designated for a print job. The predetermined number corresponds the number of sheets to be subjected to the buffer processing. The determination is performed based on information sent from the CPU circuit section 900. If the answer to the question of the step S1000 is negative (NO), the CPU 952 proceeds to a step S1001. On the other hand, if the answer to the question of the step S1000 is affirmative (YES), the CPU 952 proceeds to a step S1010. In the case of performing the staple processing, it is required to align the sheets of a sheet bundle with high accuracy. Therefore, buffering of a tab sheet is disabled so as to improve accuracy in alignment of the sheets of a sheet bundle including the tab sheet. More specifically, when the sheet P1 or P2 is a tab sheet, the CPU 952 cancels the buffer processing (step S1010). In this case, it is required to increase a sheet conveying interval in the image forming apparatus.

In the step S1001, the CPU 952 of the finisher controller 951 initializes the values of the buffer motor start-up distance X and an added distance D defining the timing for starting the buffer motor M4 to 0. As shown in FIG. 8C, the buffer motor start-up distance X represents a conveying distance at a predetermined conveying speed corresponding to a time period from a time point when the path sensor 574 detects the leading edge of the sheet P2 conveyed from the upstream apparatus to a time point when conveyance of the sheet P1 held in the buffer path is started. In FIG. 8C, the description is given assuming that the buffer motor start-up distance X is equal to the reference distance A. However, depending on the result of determination by the CPU 952, described hereinafter, the reference distance A is offset by a predetermined distance. The amount of the offset is defined as the added distance D. The added distance D is only required to be set to a value which is several millimeters longer than the length of a tab in the conveying direction.

Referring again to FIG. 11, after the path sensor 574 detects the leading edge of the sheet P2 conveyed thereto in a step S1002, the CPU 952 determines in a step S1003 whether or not the sheet P2 is a tab sheet having a protrusion protruding from its leading end in the conveying direction of the sheet P2. It should be noted that a sheet having a leading end thereof formed with a recess is also regarded as a sheet having protrusions. Whether or not the sheet P2 has a protrusion is determined based on sheet-specific sheet information received in advance from the CPU circuit section 900 before the sheet P2 reaches the conveying roller pair 532 as a component of the buffer section. In actuality, sheet information is sent from the CPU circuit section 900 before an associated sheet is passed to the finisher 500.

If it is determined in the step S1003 that the sheet P2 has a protrusion protruding from its leading end in the conveying direction, the CPU 952 determines that the sheet edge is not straight, and the CPU 952 proceeds to a step S1004. On the other hand, if the CPU 952 determines that the leading end of the sheet P2 in the conveying direction is straight, the CPU 952 proceeds to a step S1005.

In the step S1004, the CPU 952 sets the added distance D, which influences the timing for starting conveyance of the sheet P1 kept on standby in the buffer path 524, to 12.7 [mm], and the CPU 952 proceeds to a step S1006. It should be noted that the added distance D is only required to be set to a value larger than the length of the protrusion in the conveying direction, and is not limited to the above-mentioned value. In the present embodiment, the added distance D is preset based on the length of the tab of a general tab sheet. Another method may be employed in which a user or a service person sets the length of a tab as sheet information via the operation and display unit 600, and the CPU 952 determines the added distance D based on the sheet information.

In the step S1005, the CPU 952 sets the added distance D to 0 [mm], and the CPU 952 proceeds to the step S1006. Information (sheet size, basis weight, material, sheet type, etc.) on the sheet P2 is sent from the image forming apparatus 10 in advance as communication data.

If the setting of the added distance D is completed in the step S1004 or S1005, the CPU 952 sets the buffer motor start-up distance X in the step S1006. The buffer motor start-up distance X is defined by the following equation:

$$X[\text{mm}]=\text{reference distance } A[\text{mm}]+\text{added distance } D[\text{mm}]$$

Next, the CPU 952 drives the buffer motor M4 (step S1008) in timing in which a distance by which the sheet P2 has been conveyed after turn-on of the path sensor 574 and the buffer motor start-up distance X become equal to each other (YES to a step S1007). As a consequence, the sheets P1 and P2 are conveyed in a state superimposed with each other with the trailing edge of the sheet P1 shifted upstream from that of the sheet P2.

When it is determined in the step S1003 that the sheet edge is straight (NO to the step S1003) and when the added distance D is set to 0 [mm] in the step S1005, the sheet bundle is subjected to the buffer conveyance, with the sheets P1 and P2 thereof superimposed with a shift amount α (first shift amount), as shown in FIG. 12A.

Further, if it is determined in the step S1003 that the sheet edge is not straight (YES to the step S1003) and the added distance D is set to 12.7 [mm] in the step S1004, and if the path sensor 574 detects the sheet edge except the tab portion, the sheet bundle is subjected to the buffer, with the sheets P1 and P2 thereof superimposed in a state largely shifted from each other by a shift amount (second shift amount) larger than the shift amount α by the added distance D [mm], as shown in FIG. 12B.

On the other hand, if it is determined in the step S1003 that the sheet edge is not straight (YES to the step S1003) and the added distance D is set to 12.7 [mm] in the step S1004, and if the path sensor 574 detects the tab portion, the sheet bundle of the sheets P1 and P2 is conveyed, as shown in FIG. 12C, with the trailing edges of the respective sheets P1 and P2 shifted from each other by the shift amount α.

By executing the above-described control, it is possible to perform the buffer conveyance such that the relationship in the shift direction between the sheets P1 and P2 can be maintained even when a sheet having a non-straight leading edge is used.

In the present embodiment, when the leading end of the sheet P2 in the conveying direction has a protrusion, such as a tab, the added distance D is set to 12.7 [mm], whereas when the sheet P2 has no tab, the added distance D is set to 0 [mm]. This is because it is difficult to align the sheets of a sheet bundle during a stacking operation if the shift amount for buffer superposition control is set larger than necessary. In short, it is required to hold a change in the shift amount within a range which ensures tolerable degradation of sheet alignment.

In a step S1009, the CPU 952 performs control such that the sheet bundle of the sheets P1 and P2 superimposed one upon the other is discharged onto the processing tray 550. As a consequence, sheet alignment and discharge are performed by the above-described stacking operation.

As described above, according to the present embodiment, in the case of superposing a tab sheet upon a conventional rectangular sheet, the buffer superposition control is performed such that the shift amount becomes larger than in processing for superposing conventional rectangular sheets one upon the other. Consequently, even when a tab portion is detected for buffering a tab sheet, it is possible to convey the tab sheet to the processing tray while properly maintaining the sheet shift direction. Further, the present embodiment makes it possible to properly maintain alignment of the sheets of a sheet bundle on the processing tray even when a job uses sheets including particular sheets, such as tab sheets.

Although in the above-described embodiment, the image forming system comprises the sheet processing apparatus and the image forming apparatus as respective separate units, this is not limitative, but the image forming system may be formed by a sheet processing apparatus and an image forming apparatus which are formed into an integral unit.

Aspects of the present invention can also be realized by a computer of a system or apparatus (or devices such as a CPU or MPU) that reads out and executes a program recorded on a memory device to perform the functions of the above-described embodiment, and by a method, the steps of which are performed by a computer of a system or apparatus by, for example, reading out and executing a program recorded on a memory device to perform the functions of the above-described embodiment. For this purpose, the program is provided to the computer for example via a network or from a recording medium of various types serving as the memory device (e.g., computer-readable medium).

While the present invention has been described with reference to the exemplary embodiment, it is to be understood that the invention is not limited to the disclosed exemplary embodiment. The scope of the following claims is to be accorded the broadest interpretation so as to encompass all modifications, equivalent structures and functions.

This application claims priority from Japanese Patent Application No. 2010-114470 filed May 18, 2010, and Japanese Patent Application No. 2011-105478 filed May 10, 2011, which are hereby incorporated by reference herein in their entirety.

What is claimed is:

1. A sheet processing apparatus that performs processing on sheets, comprising:

a conveying unit configured to convey sheets along a conveying path;

a buffer unit configured to convey a first sheet and a second sheet following the first sheet as a sheet bundle conveyed by said conveying unit in a state where the second sheet is superimposed on the first sheet and shifted from the first sheet in a conveying direction;

a stacking unit configured to stack the first and the second sheets as the sheet bundle conveyed by said buffer unit;

a determination unit configured to determine in advance, before a sheet conveyed by said conveying unit reaches said buffer unit, whether the sheet is a particular sheet having a protrusion on a leading side thereof in the conveying direction; and a control unit configured to control a shift amount in which the second sheet is shifted from the first sheet when the first and the second sheets are conveyed by said buffer unit, according to a result of a determination by said determination unit.

2. The sheet processing apparatus according to claim 1, wherein when said determination unit determines that the sheet conveyed by said conveying unit is not the particular sheet, said control unit controls the shift amount by a first shift amount, whereas when said determination unit determines that the sheet conveyed by said conveying unit is the particular sheet, said control unit controls the shift amount by a second shift amount which is larger than the first shift amount.

3. The sheet processing apparatus according to claim 1, wherein when said determination unit determines that the second sheet is the particular sheet, said control unit inhibits said buffer unit from conveying the first and the second sheets in the state where the second sheet is superimposed on the first sheet.

4. The sheet processing apparatus according to claim 1, wherein said determination unit acquires information indicating whether the sheet is the particular sheet, from an apparatus that supplies the sheet to the sheet processing apparatus.

5. An image forming apparatus that forms images on sheets, comprising:

a conveying unit configured to convey sheets along a conveying path;

a buffer unit configured to convey a first sheet and a second sheet following the first sheet as a sheet bundle conveyed by said conveying unit in a state where the second sheet is superimposed on the first sheet and shifted from the first sheet in a conveying direction;

a determination unit configured to determine in advance, before a sheet conveyed by said conveying unit reaches said buffer unit, whether the sheet is a particular sheet having a protrusion on a leading side thereof in the conveying direction;

a stacking unit configured to stack the first and the second sheets as a sheet bundle, the particular sheet being stacked on said stacking unit such that the protrusion is positioned forward; and a control unit configured to control a shift amount in which the second sheet is shifted from the first sheet when the first and the second sheets are conveyed by said buffer unit, according to a result of a determination by said determination unit.

6. The image forming apparatus according to claim 5, wherein when said determination unit determines that the sheet conveyed by said conveying unit is not the particular sheet, said control unit controls the shift amount by a first shift amount, whereas when said determination unit determines that the sheet conveyed by said conveying unit is the particular sheet, said control unit controls the shift amount by a second shift amount which is larger than the first shift amount.

7. The image forming apparatus according to claim 5, wherein when said determination unit determines that the second sheet is the particular sheet, said control unit inhibits said buffer unit from conveying the first and the second in the state where the second sheet is superimposed on the first sheet.

8. A sheet buffering device for conveying sheets as a sheet bundle to a stacking unit, comprising:

a buffer unit configured to perform buffer processing for conveying a first sheet and a second sheet following the first sheet as the sheet bundle in a state where the second sheet is superimposed on the first sheet and shifted from the first sheet in a conveying direction;

a determination unit configured to determine in advance, before a sheet to be conveyed to the stacking unit reaches said buffer unit, whether the sheet is a particular sheet having a protrusion on a leading side thereof in the conveying direction; and a control unit configured to control a shift amount in which the second sheet is shifted from the first sheet when the first and the second sheets are conveyed by said buffer unit, according to a result of a determination by said determination unit.

9. The sheet buffering device according to claim 8, wherein when said determination unit determines that the sheet to be conveyed to the stacking unit is not the particular sheet, said control unit controls the shift amount by a first shift amount, whereas when said determination unit determines that the sheet to be conveyed to the stacking unit is the particular sheet, said control unit controls the shift amount by a second shift amount which is larger than the first shift amount.

* * * * *